US005575457A

United States Patent [19]

Inoue et al.

[11] Patent Number: 5,575,457

[45] Date of Patent: Nov. 19, 1996

[54] STRUCTURE FOR CONTROLLING BRAKING ACTION OF A MECHANICAL BRAKE OF A LEVER TYPE HOIST AND TRACTION MACHINE

[75] Inventors: Yoshitaka Inoue; Yoshiaki Okamoto; Yasuo Wada; Eikichi Kobayashi, all of Osaka Sayama, Japan

[73] Assignee: Elephant Chain Block Company, Limited, Osaka, Japan

[21] Appl. No.: 309,444

[22] Filed: Sep. 20, 1994

[30] Foreign Application Priority Data

Nov. 11, 1993 [JP] Japan ..... 5-282492
Dec. 14, 1993 [JP] Japan ..... 5-313856

[51] Int. Cl.[6] ..... B66D 1/14

[52] U.S. Cl. ..... 254/368; 254/352; 254/376; 192/95

[58] Field of Search ..... 254/352, 368, 254/369, 350, 376; 192/18 R, 93 A, 95

[56] References Cited

U.S. PATENT DOCUMENTS 4,512,555 4/1985 Nakamura ..... 192/95 X

FOREIGN PATENT DOCUMENTS 0533468 3/1993 European Pat. Off. .
3-107490 11/1991 Japan .

*Primary Examiner*—Daniel P. Stodola
*Assistant Examiner*—Emmanuel M. Marcelo
*Attorney, Agent, or Firm*—Watson Cole Stevens Davis, P.L.L.C.

[57] ABSTRACT

In a lever type hoist an operation handle (18) is provided between a stopper (17) provided at the axial end portion of a driving shaft (5) and a driving member (8) screwed on the driving shaft (5) so as to be movable in the axial direction but non-rotatable relatively to the driving shaft (5). A spring (19) for energizing the operation handle (18) toward the driving member (8) is provided to bring inclined surface (31*a*) of the engaging projection (31) provided on the operation handle (18) into elastic contact with an engaging stepped portion (37) of the driving member (8) during the time when the mechanical brake (13) is being operated, whereby the driving member (8) can be prevented from being reversely rotated while being accompanied by a returning operation of the operation lever (16) by the engaging resistance of a feed click (14) during the time when a hoist and traction operation is being conducted under the no-load condition.

3 Claims, 5 Drawing Sheets

STRUCTURE FOR CONTROLLING BRAKING ACTION OF A MECHANICAL BRAKE OF A LEVER TYPE HOIST AND TRACTION MACHINE

FIELD OF THE INVENTION

The present invention relates to a lever-type hoist and traction apparatus, in particular to a lever-type hoist and traction apparatus provided with an operation lever having a feed click and adapted to conduct a hoist and traction of loads by driving a load-sheave through a mechanical brake by a reciprocating operation of said operation lever.

BACKGROUND OF THE INVENTION

In a lever-type hoist and traction apparatus provided with an operation lever, as disclosed in for example Japanese Utility Model Application Laid-Open No. Hei 3-107490, the disclosure of which is hereby incorporated by reference, a driving shaft is provided with a driving member having teeth on its outer periphery screwed therein. In addition, said operation lever is provided with a feed click engaged with said teeth of said driving member so as to be switched over, a click portion on the feed side of the driving member being engaged with the teeth and the operation lever being reciprocally operated to forwardly screw the driving member, whereby operating a mechanical brake, a driving power due to a reciprocal operation of the operation lever being transmitted to a load-sheave from said driving shaft through said mechanical brake, and the load-sheave being driven to conduct a hoist and traction of loads. Furthermore, a click portion on the return side of the feed click is engaged with the teeth of the driving member to reciprocally operate the operation lever, whereby rearwardly screwing the driving member and thus releasing the operation of the mechanical brake to reversely rotate the load-sheave by a quantity rearwardly screwed of the driving member in order to unload or release a traction.

However, in said lever-type hoist and traction apparatus having the above described construction, the driving member is adapted to be regularly and reversely rotated by engaging one of the portion on the feed side and the return side of the feed click provided on the operation lever with the teeth provided on said outer periphery of the driving member and reciprocally operating the operation lever and the driving member is forwardly screwed by this regular rotation to operate the mechanical brake and transmit the driving power due to the reciprocal operation of the operation lever to the load-sheave from the driving shaft, whereby driving the load-sheave to be rotated, so that a disadvantage occurs in that in the case where no load is applied to the load-sheave, the driving member is forwardly screwed to operate the mechanical brake and consequently, even though the operation lever is reciprocally operated under this condition, the driving power is transmitted by a going movement of the operation lever and the operation lever is returned to a going movement-starting position without being followed by the driving member by a returning movement of the operation lever but in the case where the operation lever is reciprocally operated to operate the load-sheave in the hoist-traction direction under a no-load condition where no load is applied to the load-sheave, no-load is applied to the load-sheave, so that, even though the mechanical brake is operated during said going movement of the operation lever, an engaging resistance of the feed click engaged with the teeth of the driving member overcomes a reverse rotation resistance of the driving member to reversely rotate the mechanical brake with being accompanied by said returning movement of the operation lever, whereby releasing the mechanical brake and as a result, even though the operation lever is reciprocally operated, the driving member merely repeats the forward screwing rearward screwing and thus the mechanical brake is not operated.

So, conventionally, the operation lever is reciprocally operated with applying a load to the load-sheave or a load-chain laid on the load-sheave during the hoist-traction by means of the operation lever under the above described no-load condition or an external force is manually applied to the driving member from outside to prevent the driving member from being reversely rotated with being followed by the returning movement of the operation lever.

However, in every case, a defect occurs in that an operation for applying a load to the load-sheave or said load-chain or an operation for applying said external force to the driving member is required in addition to the reciprocal operation of the operation lever, in particular in one-man working, an operation for adding the external force by one hand with operating the operation lever by the other hand and an operation for holding a hoist and traction apparatus body must be conducted and thus the hoist and traction operation under a no-load condition is complicated.

SUMMARY OF THE INVENTION

It is an object of the present invention to provide a lever-type hoist and traction apparatus capable of effectively operating a mechanical brake by a reciprocal operation of an operation lever without adding an external force during a hoist traction operation by means of said operation lever under a no-load condition to drivenly rotate a load-sheave in the hoist traction direction by a simple operation.

In order to achieve the above described object, in a lever-type hoist and traction apparatus according to the present invention comprising a load-sheave 3, a driving shaft 5 having a driven member 7 for driving said load-sheave 3, a driving member 8 provided with teeth **8*a* on an outer periphery thereof and screwed in said driving shaft 5 and an operation lever 16 provided with a mechanical brake 13 and a feed click 14 switchably engaged with said teeth 8*a* for driving said driving member 8 in regular and reverse directions by a reciprocal operation, a stopper 17 is provided at an axial end portion of the driving shaft 5, an operation handle 18 movable in the axial direction but unrotatable relatively to the driving shaft 5 being provided between said stopper 17 and the driving member 8, a spring 19 for energizing said operation handle 18 in the direction approaching the driving member 8 being provided, an engaging projection 31 projecting toward the driving member 8 being provided on a surface opposite to the driving member 8 of the operation handle 18, an engaging stepped portion 37, with which said projection 31 is engaged, being provided on a surface opposite to the side of the operation handle 18 of the driving member 8, and an inclined surface 31*a* inclined on the rear outward side of the regular rotation of the driving member 8 toward the base end side from the front end side of the projection 31 being provided on the side before in the direction of the regular rotation of the driving member 8 in the projection 31 to bring said inclined surface 31*a* into elastic contact with said engaging stepped portion 37 by an energizing force of said spring 19 during the time when said mechanical brake 13** is being operated.

In addition, it is preferable that an end face in the axial direction of the engaging projection 31 provided in the operation handle 18 is engaged with said surface opposite to the operation handle 18 of the driving member 8 during a rotational operation of the operation handle 18 relatively to the driving member 8, a projected portion 32 having an idling-controlling surface 35 brought into elastic contact by said energizing force of the spring 19 being provided, and said projected portion 32 being provided with an engaging stepped portion 37 at a rear end portion in the rotational direction thereof. Furthermore, it is preferable that an idling-controlling spring 50 for energizing the driving member 8 in the brake-loosening direction of the mechanical brake 13 is provided between the driving member 8 and the operation handle 18.

Besides, it is preferable that the stopper 17 is connected with the driving shaft 5 by a connecting structure using a large number of concave and convex grooves 17*a*, 23*a*, concave portions 30 and convex portions 29 engaged with said concave portions 30 being provided between opposite surfaces of the stopper 17 and the operation handle 18, a plurality of at least ones of the concave portions 30 and said convex portions 29 being provided at regular intervals in the circumferential direction, and their pitch angles being selected so as to be different from those of said concave and convex grooves 17*a*, 23*a* provided between the stopper 17 and the driving shaft 5 and ones obtained by multiplying said pitch angles of the concave and convex grooves 17*a*, 23*a* by integers.

According to the present invention, said engaging stepped portion 37 provided on the driving member 8 is brought into elastic contact with the inclined surface 31*a* of the engaging projection 31 provided on the operation handle 18 during the time when the mechanical brake 13 is being operated, so that a force is given to the driving member 8 in the brake-fastening direction at the same time as a rotational resistance is given even under the no-load condition where no load is applied to the load-sheave 3. As a result, the driving member 8 can be prevented from being reversely rotated with being accompanied by a returning operation of said operation lever 16 by an engaging resistance of said feed click 14 provided on the operation lever 16 and engaged with teeth 8*a* of the driving member 8 during the time when the hoist and traction of the load-sheave 3 is being conducted by the reciprocal operation of the operation lever 16. As a result, the mechanical brake 13 can be always operated by operating the operation lever 16 even under the no-load condition and thus the load-sheave 3 can be drivenly rotated in the hoist-traction direction through the mechanical brake 13.

Consequently, in the case where the load-sheave 3 is drivenly operated in the hoist-traction direction under the no-load condition, the conventional complicated operations for applying the load to the load-sheave and applying the external force to the driving member can be made unrequired and thus the hoist and traction operation under the no-load condition can be simplified.

In addition, the end face of the engaging projection 31 provided on the operation handle 18 is engaged with the driving member 8 and the projection 32 having an idling-controlling surface 35 brought into elastic contact by the energizing force of the spring 19 is provided, whereby an idling condition can be held by bringing the projection 31 into elastic contact with said idling-controlling surface 35 by operating the operation handle 18 and thus an input range of a tension of the load-chain during the idling-control can be expanded. As a result, the load-chain can be adjusted in length without requiring a skill. Furthermore, the engaging stepped portion 37 is provided at the rear end portion in the drivenly rotating direction of the projection 32 and the projection 37 is brought into elastic contact with the inclined surface 31*a* of the projection 31 during the time when the mechanical brake 13 is being operated, so that the hoist and traction operation by the reciprocal operation of the operation lever becomes possible by a simple construction utilizing the projection 32 even under the no-load condition.

Moreover, the driving member 8 can be rotated by an action of the idling-controlling spring 50 to loosen the mechanical brake 13 by the simple operation of merely drawing the operation handle 18 to the outside position far from the driving member 8 by providing the idling-controlling spring 50 between the driving member 8 and the operation handle 18. Consequently, even in the case where the idling operation is conducted by an inexperienced person, the idling operation can be easily achieved, the operatability being able to be improved, and the error operation being able to be eliminated, and thus also a disadvantage that the idling-controlling is impossible due to the error operation can be eliminated.

Besides, the position where the inclined surface 31*a* of the engaging projection 31 provided on the operation handle 18 is brought into elastic contact with the engaging stepped portion 37 provided on the driving member 8 when the inclined surface 31*a* is brought into elastic contact with the engaging stepped portion 37 can be set to the suitable one, that is one near a top portion of the projection 31 in the inclined surface 31*a*, in high accuracy by merely adjusting the position of the operation handle 18 in the circumferential direction relative to the stopper 17, in short by the simple operation of merely changing the engaging positions of the concave and convex portions 29, 30, by providing a plurality of at least ones of the concave portions 30 and the convex portions 29 provided between the opposite surfaces of the stopper 17 and the operation handle 18 at regular intervals in the circumferential direction and selecting their pitch angles so as to be different from those of said concave and convex grooves 17*a*, 23*a* connecting the stopper 17 with the driving shaft 5 and ones obtained by multiplying the pitch angles of the concave and convex grooves 17*a*, 23*a* by integers. Additionally, the adjustment of this elastically contacting position can be easily achieved even though a lining plate of the mechanical brake 13 is abraded and the elastically contacting position is out of order.

DETAILED DESCRIPTION OF THE INVENTION

Figure 1:
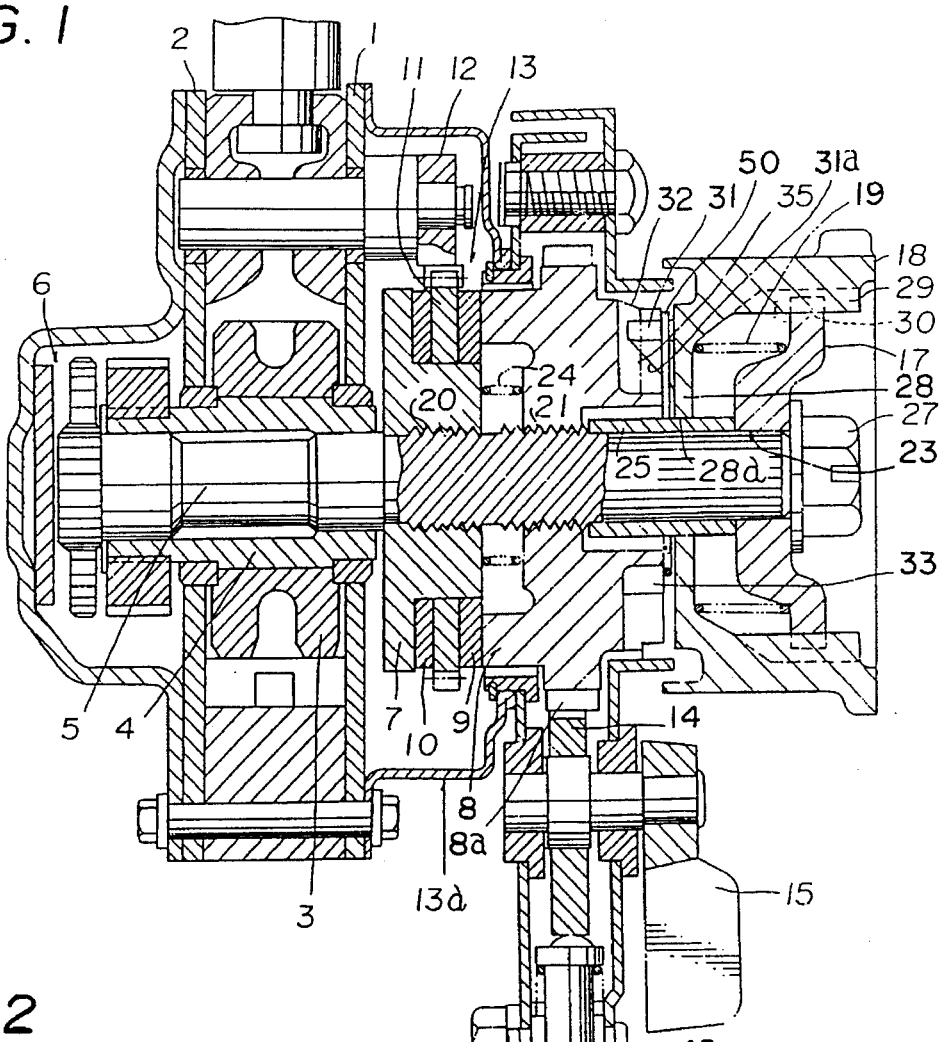
FIG. 1 is a longitudinal sectional view showing one preferred embodiment of a lever-type hoist and traction apparatus according to the present invention.

A preferred embodiment shown in FIG. 1 relates to a lever-type hoist and traction apparatus without an overload-preventing device. A cylindrical shaft 4 having a load-sheave 3 is rotatably supported between first and second side plates 1, 2 arranged oppositely at a predetermined interval, a driving shaft 5, to which a rotary power is transmitted from the side of an operation lever described later, being relatively rotatably supported within said cylindrical shaft 4, and a reduction gear mechanism 6 comprising a plurality of reduction gears being provided between an outside end portion projected from said second side plate 2 of said driving shaft 5 and said load-sheave 3 to reducedly transmit said rotary power of the driving shaft 5 to the side of the load-sheave 3 by means of said reduction gear mechanism 6.

In addition, a driven member 7 formed of a hub having a flange is screwed on the outside of the driving shaft 5 projected from said first side plate 1, a driving member 8 having teeth 8*a* on an outer periphery thereof being screwed in the driving shaft 5 an outer side of said driven member 7, and a pair of brake plates 9, 10 and a brake click wheel 11 being provided between said driving member 8 and the driven member 7. Additionally, the first side plate 1 is provided with a brake click 12 to be engaged with said brake click wheel 11 and a mechanical brake 13 is composed of the brake click wheel 11 and the respective brake plates 9, 10.

Furthermore, a feed click 14 provided with a click portion on the feed side and a click portion on the return side engageable with said teeth 8*a* provided on an outer circumferential portion of the driving member 8 is provided on an outer side in the radial direction of the driving member 8 in a portion outside of a brake cover 13*a* covering an outer circumferential portion of said mechanical brake 13 and an operation lever 16 provided with an operational portion 15 selectively engaging and disengaging with said click portion on the feed side and said click portion on the return side of said feed click 14 is provided.

And, the driving shaft 5 is provided with a stopper 17 at an axial end portion thereof, an operation handle 18, which is unrotatable relatively to the driving shaft 5, is provided between said stopper 17 and the driving member 8 so as to be movable in the axial direction from a first position near the driving member 8 to a second position far from the driving member 8, a spring 19 mainly formed of a coil spring energizing the operation handle 18 toward the driving member 8 being provided between the operation handle 18 and the stopper 17, and regulating means, which regulates a rotatable range of the operation handle 18 relatively to the driving shaft 5 of the driving member 8 and deregulates said rotatable range of the operation handle 18 relatively to the driving shaft 5 of the driving member 8 by a movement of the operation handle 18 in the direction far from the driving member 8, in short a movement toward the second position, being provided between the operation handle 18 and the driving member 8.

That is to say, in said preferred embodiment shown in FIG. 1, the driving shaft 5 is provided with a serration portion 23 having first and second screw portions 20, 21 and a large number of concave and convex grooves, the driven member 7 being screwed in said first screw portion 20 while the driving member 8 is screwed in said second screw portion 21, a coil spring 24 being provided between the driven member 7 and the driving member 8 to restrict a movement in the axial direction of the driven member 7 relative to the driving shaft 5, the driving member 8 being screwed in the leftward direction in FIG. 1 by regularly rotating the driving member 8 relatively to the driving shaft 5, said serration portion 23 being engaged with a sleeve 25 on the outer side of the driving member 8, the stopper 17 being connected with an end portion of the serration portion 23 on the outer side of said sleeve 25 by a connecting structure comprising a large number of concave and convex grooves, and the stopper 17 being fixedly mounted on the driving shaft 5 through the sleeve 25 by fastening a nut 27.

Moreover, an engaging hole 28*a* provided in a boss portion 28 of the operation handle 18 is engaged with the sleeve 25, the operation handle 18 being provided between the stopper 17 and the driving member 8 under the condition that the driving shaft 5 is movable in the axial direction and rotatable, the operation handle 18 being provided with a pair of convex portions 29 on an inner circumferential surface thereof while the stopper 17 is provided with a pair of concave portions 30, with which said convex portions are to be engaged, on the outer circumferential portion thereof, and the convex portions 29 of the operation handle 18 being engaged with said concave portions 30 of the stopper 30 to make the operation handle 18 non-rotatable relatively to the driving shaft 5.

Besides, said spring 19 is provided between an outside surface of said boss portion 28 of the operation handle 18 and an inside surface opposite to the boss portion 28 of the stopper 17 to press the operation handle 18 in the direction toward the driving member 8 by an energizing power of the spring 19.

Figure 2:
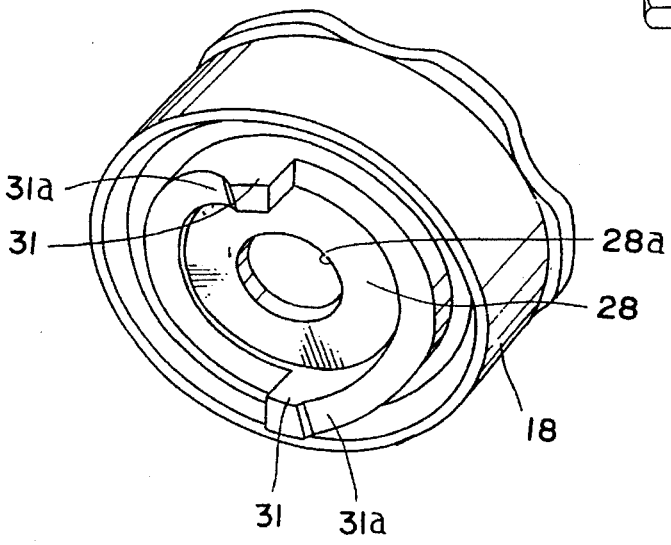
FIG. 2 is a perspective view of the inside of an operation handle.
Figure 3:
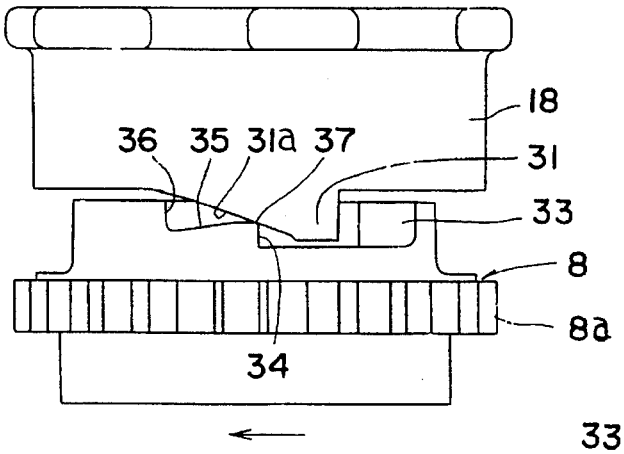
FIG. 3 is a side view showing a relationship between said operation handle and a driving member.
Figure 4:
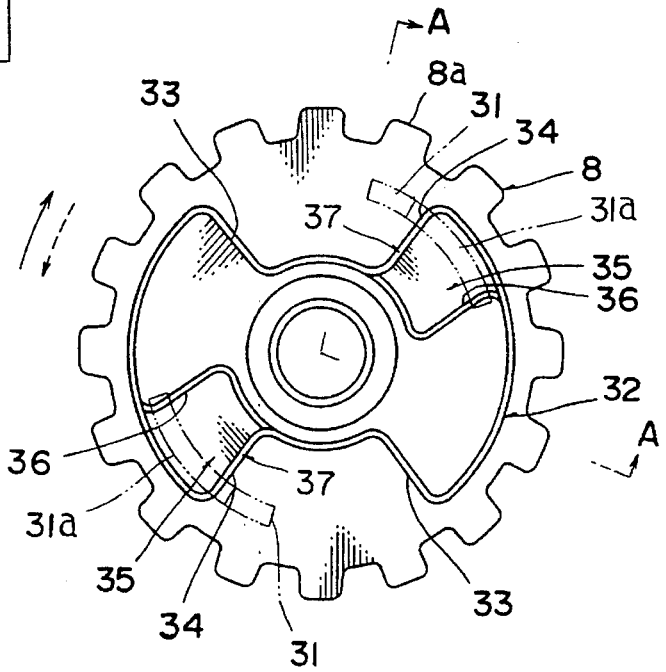
FIG. 4 is a front view showing a positional relationship between an engaging stepped portion of said driving member and an engaging projection of the operation handle during ordinary use.

Additionally, the boss portion 28 of the operation handle 18 is provided with two engaging projections 31 projecting toward the side of the driving member 8 at end portions in the radial direction on the rear surface side thereof symmetrically, as shown by a dotted line in FIG. 4, the driving member 8 being provided with a pair of projections 32 on the side opposite to the boss portion 28 of the operation handle 18 thereof symmetrically, as shown in FIG. 4, said projections 32 being provided with first and second regulating surfaces 33, 34 which are engaged with said engaging projections 31 to restrict said relative rotatable range of the driving member 8 relative to the driving shaft 5, whereby constructing said regulating means, when the driving member 8 is rotated relatively to the driving shaft 5, of said regulating surfaces 33, 34, said second regulating surface 34 positioned at a rear end portion in the regular rotation direction of the projections 32 being provided with an engaging stepped portion 37 with which said engaging projection 31 is to be engaged, an inclined surface 31*a* inclined rearwardly and outwardly in the regular rotation direction of the driving member 8 toward a base end side from a front end side of the projection 31 being provided on the front side in the regular rotation direction of the driving member 8 in the projection 31, as shown in FIGS. 2, 3, and said inclined surface 31 being brought into elastic contact with said engaging stepped portion 37 by an energizing force in the axial direction of the spring 19 under the condition that the mechanical brake 13 is being operated, in short the driving member 8 is being forwardly screwed to operate the mechanical brake 13.

Figure 7:
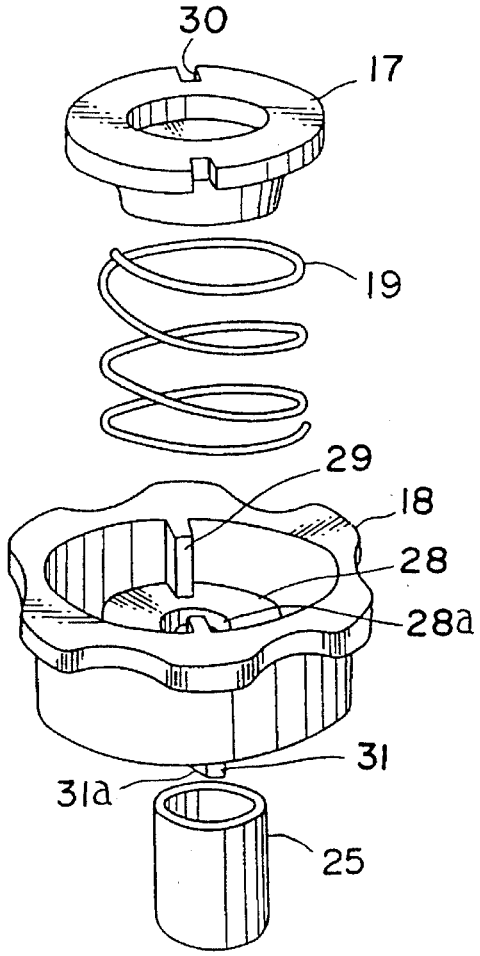
FIG. 7 is an exploded perspective view showing principal members.
Figure 7:
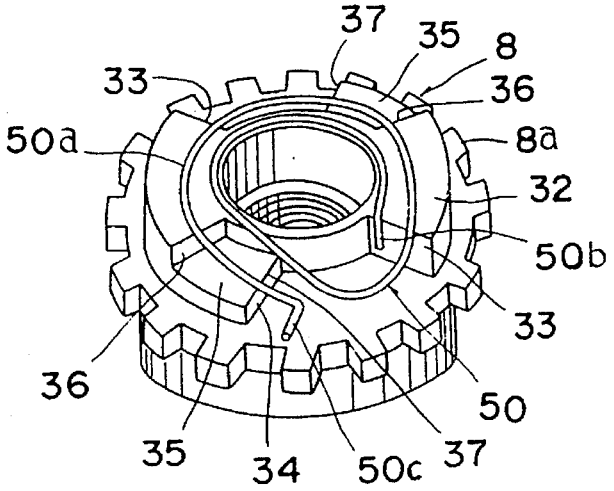

In addition, in the preferred embodiment shown in the drawings, an idling-controlling spring 50 for energizing the driving member 8 in the brake-loosening direction of the mechanical brake 13 is provided between the driving member 8 and the operation handle 18, the projection 32 being provided with an idling-controlling surface 35 which is continual from the second regulating surface 34 and moves the operation handle 18 to the second position far from the driving member 8 to rotate the driving member 8 relatively to the driving shaft 5 by an energizing force in the return direction of said idling-controlling spring 50, whereby bringing a projected front end surface of the engaging projection 31 into contact with the driving shaft 5 by energizing the spring 19 in the axial direction when the mechanical brake 13 is loosened and thus gives a rotary resistance to the driving member 8 to hold an idling rotation, and the projection 32 being provided with a third regulating surface 36, which rises from said idling-controlling surface 35 and is engaged with the front side in the rotary direction of the engaging projection 31 when the driving member 8 is rotated relatively to the driving shaft 5 under the condition that the front end surface of the engaging projection 31 is brought into contact with the idling-controlling surface 35, as shown in FIGS. 1, 7.

Furthermore, referring to FIG. 1, reference numeral 44 designates a click-holding mechanism holding the feed click 14 at three positions, that is, a feed position (regularly rotating position) where the click portion on the feed side of the feed click 14 is engaged with the teeth 8*a* of the driving member 8, a return position (reversely rotating position) where the click portion on the return side is engaged with the teeth 8*a* and a neutral position where neither of the click portion on the feed side and the click portion on the return side is engaged with the teeth 8*a*, said click-holding mechanism 44 comprising a pressing member 45 and a spring 46, and letters, such as for example "feed", "return", and "neutral" or "sidling", being displayed on an outer surface of the operation lever 16 for indicating the operating positions of said operational portion 15 of the feed click 14.

Moreover, although the driving shaft 5 is provided with the first- and second screw portions 20, 21 thereon to screw the driven member 7 and the driving member 8 therein taking the workability and strength of the driving shaft into consideration in the above described construction, also a serration may be used as the first screw portion 20. In addition, although, in the case where the driven member 7 is screwed by providing the first screw portion 20, the forward screwing of the driven member 7 is restricted by means of the coil spring 24, the second screw portion 21 may be provided with an E-ring to provide the coil spring 24 between said E-ring and the driven member 7. Furthermore, tapped grooves of the first screw portion 20 may be coated with nylon resins having an increased elastic repulsion and a frictional splicing force made by U.S. Nylock, Inc. to restrict the forward screwing of the driven member 7 by a return-preventing effect thereof. Besides, the driven member 7 may be fixedly mounted on the driving shaft 5 by screwing or striking a cotter pin and thus the spring 24 is not required.

An operation of the lever-type hoist and traction apparatus having the above described construction will be below described.

At first, in case of a loading operation, the click portion on the feed side of the feed click 14 is engaged with the teeth 8*a* of the driving member 8 by operating the operational portion 15 provided on the operation lever 16 to reciprocally operate the operation lever 16, whereby rotating the driving member 8 in the regularly rotating direction. At this time, if the load is applied to the load-sheave 3, the driving member 8 is screwed in the leftward direction in FIG. 1, that is to the side of the driven member 7, and this forward screwing condition is maintained to operate the mechanical brake 13.

On the other hand, in the case where no load is applied to the load-sheave 3, in the conventional examples, the driving member 8 is reversely rotated with the return movement of the lever 16 if the engaging resistance of the click portion on the feed side engaged with the teeth 8*a* is larger than the reverse rotating resistance of the driving member 8 during the return movement of the lever 16 and thus the mechanical brake 13 cannot be operated even though the lever 16 is reciprocally operated. However, according to the present invention, when the mechanical brake 13 is operated by the rotation of the driving member 8 resulting from the going movement of the lever 16, the engaging stepped portion 37 is brought into elastic contact with the inclined surface 31*a* of the engaging projection 31 of the operation handle 18 to act the energizing force in the axial direction of the spring 19 upon the driving member 8, thereby pressing the driving member 8 inward (toward the load-sheave) in the axial direction. As a result, a resistance is given to the reverse rotation of the driving member 8 and simultaneously the engaging stepped portion 37 is brought into elastic contact with the inclined surface 31*a*, so that a force component rotating the driving member 8 in the brake-fastening direction acts upon the driving member 8 by the energizing force of the spring 19 to give the reverse rotating resistance larger than a engaging resistance caused by the feed click 14 to the driving member 8.

Consequently, even under the no-load condition where no load is applied to the load-sheave 3, after the driving member 8 was forwardly screwed by the movement of the lever 16, the driving member 8 is not reversely rotated to be rearwardly screwed even when the returning movement operation is conducted, and as a result, the forward screwing of the driving member 8 is maintained and thus the mechanical brake 13 is operated.

And, by the action of the mechanical brake 13, the rotary power of the driving member 8 resulting from the movement operation of the operation lever 16 is transmitted to the side of the load-sheave 3 through the reduction gear mechanism 6 and the cylindrical shaft 4 from the driving shaft 5 and a load to be lifted is connected with the chain laid around the load-sheave 3 are loaded.

On the other hand, in case of an unloading operation, the click portion on the return side of the feed click 14 in the operational portion 15 is engaged with the teeth 8*a* of the driving member 8 to swingably operate the lever 16, whereby rotating the driving member 8 in the reverse rotating direction. As a result, the driving member 8 is screwed rearwardly relatively to the driven member 7 and thus the braking action of the mechanical brake 13 is stopped to be capable of reversely rotating the driving shaft 5 by the number of the reverse rotations of the driving member 8 and thus the unloading operation can be safely conducted.

The case where said chain laid around the load-sheave 3 is freely lengthened and shortened to the load side under the idling condition of the load-sheave 3 will be below described.

Figure 5:
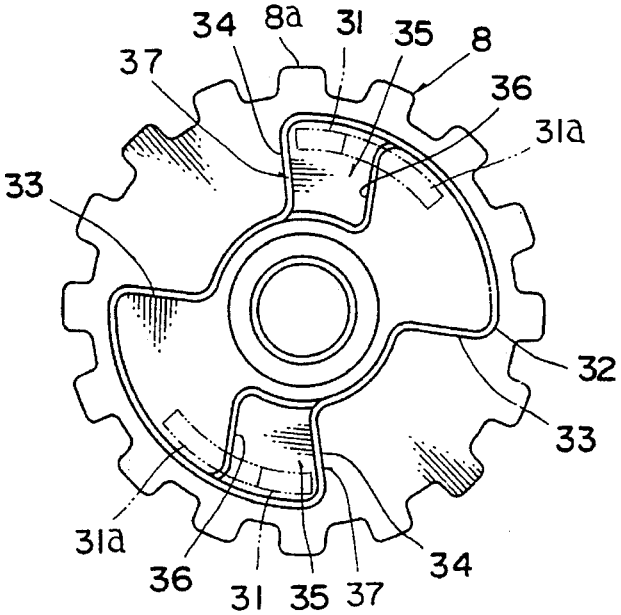
FIG. 5 is a front view corresponding to FIG. 4 and showing a positional relationship during an idling-control.

In this case, the feed click 14 is positioned at the neutral position and the operation handle 18 is drawn to the side of the stopper 17, that is the second position far from the driving member 8, against the energizing force in the axial direction of the spring 19 under this condition. As a result, the projection 31 provided on the operation handle 18 is moved to a regulation-releasing position which is not regulated by the first and second regulating surfaces 33, 34. By this regulation-releasing and the switching of the feed click 14 to the neutral position, the driving member 8 is rotated in the brake-loosening direction (the direction shown by a dotted line in FIG. 4) by the energizing force in the twisting direction of the idling-controlling spring 50 to take the condition shown in FIG. 5.

Figure 6:
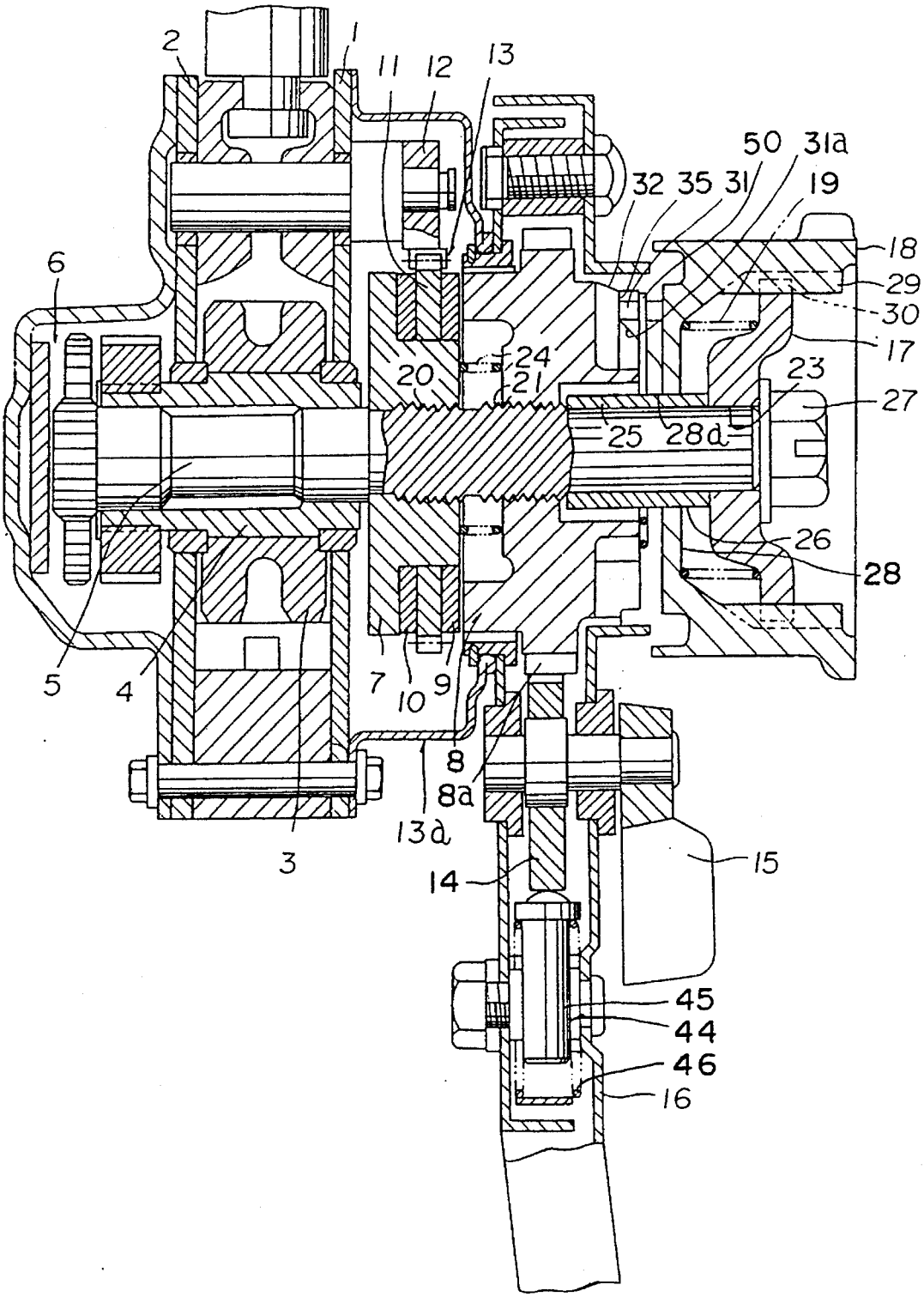
FIG. 6 is a longitudinal sectional view corresponding to FIG. 1 and showing said idling-control.

Consequently, by merely using the spring force of the spring 50 as the spring force capable of rotating the driving member 8 to the brake-loosening position to draw the operation handle 18 to the second position, the driving member 8 can be rotated to be rearwardly screwed in the direction far from the driven member 7, the braking action by the mechanical brake 13 being capable of being cancelled, and the load-sheave 3 being capable of being brought into the idling condition. Moreover, at this time, the projection 31 is moved to the position shown by a dotted line in FIG. 5 from the position shown by a dotted line in FIG. 4 to be opposite to the idling-controlling surface 35 of the driving member 8 and when the drawing operation of the operation handle 18 is released under this condition, the operation handle 18 is pressed toward the driving member 8 by the energizing force in the axial direction of the spring 19 and the projected front end surface of the projection 31 is brought into elastic contact with the idling-controlling surface 35 of the projection 32 provided on the driving member 8, as shown in FIG. 6, whereby the idling rotation condition of the load-sheave 3 is held by the frictional resistance resulting from this elastic contact. Consequently, during the idling rotation when the chain is pulled to speedily lengthen and shorten the chain on the load side, the input range of the tension of the chain can be expanded as compared with that in the conventional examples and the chain on the load side can be lengthened and shortened without required any special skill.

In addition, when the tension of the chain is enhanced under the above described idling-controlling condition and the strong force is acted upon the load-sheave 3 in the reverse rotating direction, the elastic contact of the projected front end surface of the engaging projection 31 with the idling-controlling surface 35 is slippedly released to return the engaging projection 31 between the first regulating surface 33 and the second regulating surface 34, whereby the condition that the braking operation of the mechanical brake 13 can be conducted and suspended, as above described, is recovered. That is, when the strong force is acted upon the load-sheave 3 in the reverse rotating direction, the driving member 8 is screwed in the driving shaft 5 and its rotary inertia is large as compared with that of the driving shaft 5, so that the idling-controlling surface 35 overcomes the twisting energizing force of the spring 19 to be slipped relatively to the engaging projection 31, whereby the driving member 8 beings to start to rotate slightly behind the rotation of the operation handle 18. As a result, the elastic contact of the projected front end surface of the engaging projection 31 with the idling-controlling surface 35 is released to return the engaging projection 31 between the first regulating surface 33 and the second regulating surface 34.

Furthermore, in the case where the load-sheave 3 is adjusted in length by controlling the idling in the above described manner to conduct the loading and the traction, the feed click 14 is switched over to the feed position from the neutral position to engage the click portion on the feed side with the teeth 8*a* and operate the operation lever 16, whereby the mechanical brake 13 can be easily returned to the operating condition. That is to say, when the operation lever 16 is operated under the condition that the click portion on the feed side is engaged with the teeth 8*a*, a rotary resistance is given to the driving shaft 5 by the strained load-chain, so that the driving member 8 is rotated in the regular rotating direction, in short in the feed direction, to be rearwardly screwed, whereby the mechanical brake 13 is operated and the load-sheave 3 is rotated through the mechanical brake 13 and as a result, a hoist and traction movement can be performed.

Besides, in the above described preferred embodiment, in order to install the operation handle 18 and the stopper 17, the driving member 8 is screwed on the driving shaft 5, the mechanical brake 13 being fastened to be brought under the operating condition, and the click portion on the feed side of the feed click 14 of the operation lever 16 installed in advance being engaged with the teeth 8*a* of the driving member 8, followed by engaging the sleeve 25 with the serration portion 23 of the driving shaft 5, engagedly inserting the engaging hole 28*a* of the boss portion 28 in the operation handle 18 into the sleeve 25, positioning the inclined surface 31*a* in the engaging projection 31 of the handle 18 so as to be brought into elastic contact with the engaging stepped portion 37 of the driving member 8 in the vicinity of the top portion of the projection 31, engaging the stopper 17 with the serration portion 23 with holding this condition and adjusting so that the concave portion 30 of the stopper 17 may coincide with the convex portion 29 of the operation handle 18, and fastening the nut 27 to fixedly mount the stopper 17 on the driving shaft 5.

Figure 8:
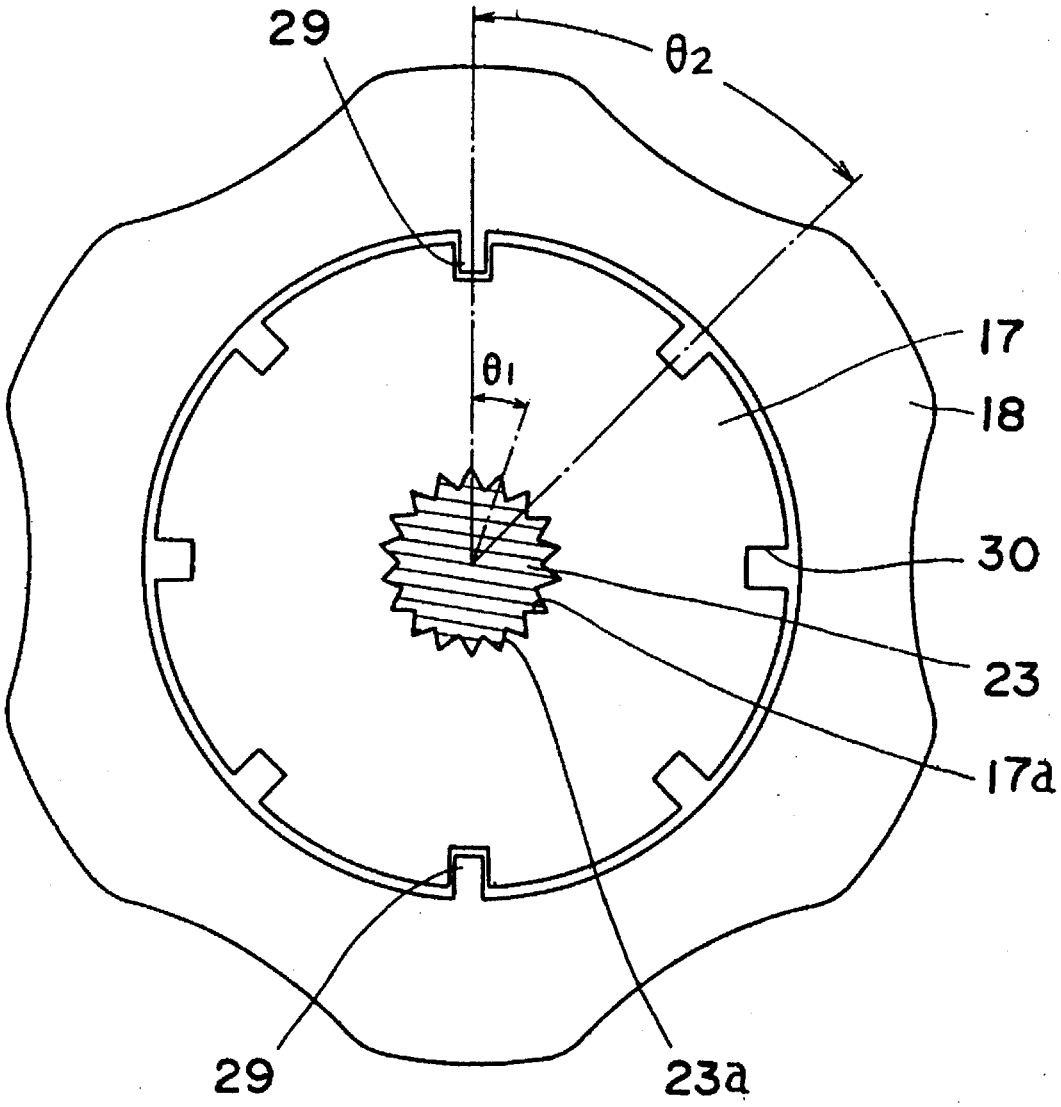
FIG. 8 is a diagram showing a relationship between the operation handle and a stopper.

By the way, in the above described construction, if the pitch angles of the concave and convex grooves of the serration portion 23 and the concave and convex grooves to be engaged with the concave and convex grooves of the serration portion 23 of the stopper 17 are reduced, even though the concave and convex grooves of the stopper 17 are shifted from the concave and convex grooves of the serration portion 23 when the concave portion 30 of the stopper 17 is coincidedly engaged with the convex portion 29 of the operation handle 18 held at the above described elastic contact position, one pitch angle of the respective concave and convex grooves is largest, so that the quantity of the shift of the position of elastic contact of the inclined surface 31*a* in the projection 31 with the engaging stepped portion 37 is not increased but in the case where the pitch angles of the concave and convex grooves are set at for example 15° to 20°, that is the number of the concave and convex grooves 17*a* of the stopper 17 and the concave and convex grooves 23*a* of the serration portion 23 is set to 18, respectively, as shown in FIG. 8, the maximum shift of the elastic contact position corresponding to 20° is brought about.

Consequently, the force component in the brake-fastening direction of the driving member 8 by the spring 19 is reduced by this shift and the reverse rotary resistance larger than the engaging resistance by the feed click 14 can not be given to the driving member 8 under certain circumstances but the shift of the elastic contact position can be easily eliminated by providing a plurality of at least ones of the concave portions 30 and said convex portions 29 at regular intervals in the circumferential direction and selecting the pitch angles so as to be different from those of said concave and convex grooves 17*a*, 23*a* provided on the stopper 17 and the serration portion 23 of the driving shaft 5 and ones obtained by multiplying the pitch angles of the concave and convex grooves 17*a*, 23*a* by integers.

That is to say, in the preferred embodiment shown in FIG. 8, the pitch angles $\theta_1$ of the concave and convex grooves 17*a*, 23*a* provided on the stopper 17 and the serration portion 23 are set at 20°, a pair of convex portions 29 shifted in phase by 180° being provided on the operation handle 18, and the stopper 17 being provided with 8 concave portions 30, with which the convex portions 29 are to be engaged, at the pitch angles $\theta_2$ of 45° in the circumferential direction.

Consequently, the position of the operation handle 18 relative to the stopper 17 in the circumferential direction can be shifted by 5° by shifting the position, where the concave portions 30 are engaged with the convex portions 29, by one pitch angle $\theta_2$, that is 45°, under the condition that the stopper 17 is shifted relatively to the serration portion 23 of the driving shaft 5 by two pitch angles $2\theta_1$, that is 40°. In addition, the position of the operation handle 18 relative to the stopper 17 in the circumferential direction can be shifted by 10° by shifting the position, where the concave portions 30 are engaged with the convex portions 29, by two pitch angles $2\theta_2$, that is 90°, under the condition that the stopper 17 is shifted relatively to the serration portion 23 of the driving shaft 5 by four pitch angles $4\theta_1$, that is 80°. Furthermore, the position of the operation handle 18 relative to the stopper 17 in the circumferential direction can be shifted by three pitch angles $3\theta_2$, that is 135°, by shifting the position, where the concave portions 30 are engaged with the convex portions 29, by six pitch angles $6\theta_1$, that is 120°, under the condition that the stopper 17 is shifted relatively to the serration portion 23 of the driving shaft 5 by six pitch angles $6\theta_1$, that is 120°. That is to say, the position of the operation handle 18 relative to the stopper 17 in the circumferential direction can be adjusted to 3 steps of 5°, 10° and 15°.

Besides, the pitch angles of the concave and convex grooves 17*a*, 23*a* of the stopper 17 and the serration portion 23 are not limited by the above described 20° but they may be set to for example 15°. In the case where the pitch angles of the concave and convex grooves 17*a*, 23*a* are set to 15°, the pitch angles of the concave portions 30 provided in the stopper 17 are set differently from not only ones of 15° but also ones obtained by multiplying 15° by integers. That is to say, they are set to for example 36°.

In this case, the position of the operation handle 18 relative to the stopper 17 in the circumferential direction can be adjusted at four steps of 0°, 3°, 6° and 9°. In addition, in the preferred embodiment shown in FIG. 8, a plurality of concave portions 30 were provided in the stopper 17 at the pitch angles selected so as to be different from the pitch angles of the concave and convex grooves and ones obtained by multiplying the pitch angles of the concave and convex grooves by integers but a plurality of convex portions 29 may be provided in the operation handle 18 at the pitch angles selected so as to be different from the pitch angles of the concave and convex grooves and ones obtained by multiplying the pitch angles of the concave and convex grooves by integers.

Furthermore, the operation handle 18 was provided with the convex portions 29 and the stopper 17 was provided with the concave portions 30 but the operation handle 18 may be provided with the concave portions 30 and the stopper 17 may be provided with the convex portions 29.

Besides, in the case where the above described construction is adopted, in order to install the operation handle 18 and the stopper 17, the same method as the above described one is used but the operation handle 18 is positioned so that the inclined surface 31*a* in the engaging projection 31 of the handle 18 may be brought into elastic contact with the engaging stepped portion 37 of the driving member 8 at the vicinity of the top portion thereof and the concave portion 30 of the stopper 17 nearest the convex portion 29 of the operation handle 18 is engaged with the convex portion 29 under the above described condition held to install the stopper 17 in the serration portion 23 of the driving shaft 5.

In this case, if the concave portion 30 is shifted relative to the convex portion 29 in position, the stopper 17 is rotated by every 2 pitch angles of the concave and convex grooves 17*a* to be adjusted, whereby being engaged under the nearest condition. As a result, the position of the operation handle 18 relative to the driving member 8, in short the position where the inclined surface 31*a* is brought into elastic contact with the engaging stepped portion 37, can be set at the optimal position in the vicinity of the top portion or positions near the optimal position and thus the elastic contact position can be accurately and simply determined, whereby the installability can be improved.

In addition, even in the case where the braking plates 9, 10 and the like in the mechanical brake 13 were abraded, the adjustment can be easily conducted by changing the position of the stopper 17 relative to the operation handle 18 in the above described installing procedure under the condition that the operation handle 18 is positioned at the proper elastic contact position and also the readjustment can be simply conducted.

Although the operation handle 18 is energized in the axial direction by means of the spring 19 and the driving member 8 is energized in the brake-loosening direction by means of the idling-controlling spring 50 in the above described preferred embodiment, the idling-controlling spring 50 may be omitted to merely energize the operation handle 18 in the axial direction by means of the spring 19.

In addition, in the case where the idling-controlling spring 50 is used, a coil spring may be used as the idling-controlling spring 50 but a flat spring is preferably used, as shown in FIGS. 1, 7.

That is to say, the idling-controlling spring 50 shown in FIGS. 1, 7 comprises a twisted portion 50*a* twisted spirally in a single plane and first- and second spring legs 50*b*, 50*c* positioned at both ends of said twisted portion 50*a*, said first spring leg 50*b* being bent at right angles to the axial direction of the twisted portion 50*a* to be engaged with the first regulating surface 33 of the driving member 8, and the second spring leg 50*c* being bent in the radial direction relative to the twisted portion 50*a* to be engaged with the front side surface of the engaging projection 31 of the operation handle 18, that is the front side surface in the regular rotating direction of the driving member 8.

Furthermore, although the driving member 8 is formed of the single member to be screwed on the driving shaft 5 in the above described preferred embodiment, the driving member 8 may comprise a brake-pressing member screwed on the driving shaft 5 and a body of revolution rotatably supported on a cylindrical portion of said brake-pressing member and provided with teeth on an outer circumference thereof. In this case, a lining plate is provided between the brake-pressing plate and said body of revolution, said lining plate and a flat spring being supported on the brake-pressing member outside of the body of revolution, and a load-setting and adjusting member being screwed to comprise an overload-preventing mechanism.

In the case where said overload-preventing mechanism is incorporated in such the manner, the same shape as the projection 32 is given to said load-setting and adjusting member and the load-setting and adjusting member is provided with the first- and second regulating surfaces 33, 34 and the idling-controlling surface 35 to form the engaging stepped portion 37 at the end portion of the second regulating surface 34.

In addition, in the present preferred embodiment, the driving member means the whole overload-preventing mechanism including the brake-pressing member and the load-setting and adjusting member and the member, on which the engaging stepped portion 37 is to be provided, is not limited by the load-setting and adjusting member but the engaging member may be provided on the brake-pressing member or a member fixedly mounted on the brake-pressing member. Furthermore, in the case where the idling-controlling spring energizing the driving member in the brake-loosening direction is provided, the spring leg of this spring may be engaged with the load-setting and adjusting member or the brake-pressing member or said member fixedly mounted on the brake-pressing member. Furthermore, in the case where the idling-controlling spring is provided, the flat spring shown in FIGS. 1, 7 is preferably used.

Besides, according to the present invention, although it is preferable that the driving member 8 is provided with the idling-controlling surface 35 so that the engaging projection 31 may be brought into elastic contact with the idling-controlling surface 35 to hold the idling condition, it is not indispensable.

EFFECTS OF THE INVENTION

According to the present invention, said engaging stepped portion 37 provided on the driving member 8 is brought into elastic contact with the inclined surface 31*a* of the engaging projection 31 provided on the operation handle 18 during the time when the mechanical brake 13 is being operated, so that a force is given to the driving member 8 in the brake-fastening direction at the same time as a rotational resistance is given even under the no-load condition where no load is applied to the load-sheave 3. As a result, the driving member 8 can be prevented from being reversely rotated with being accompanied by a returning operation of said operation lever 16 by an engaging resistance of said feed click 14 provided on the operation lever 16 and engaged with teeth 8*a* of the driving member 8 during the time when the hoist and traction of the load-sheave 3 is being conducted by the reciprocal operation of the operation lever 16. As a result, the mechanical brake 13 can be always operated by operating the operation lever 16 even under the no-load condition and thus the load-sheave 3 can be drivenly rotated in the hoist traction direction through the mechanical brake 13.

Consequently, in the case where the load-sheave 3 is drivenly operated in the hoist traction direction under the no-load condition, the conventional complicated operations for applying the load to the load-sheave and applying the external force to the driving member can be made unnecessary and thus the hoist and traction operation under the no-load condition can be simplified.

In addition, the end face of the engaging projection 31 provided on the operation handle 18 is engaged with the driving member 8 and the projection 32 having an idling-controlling surface 35 brought into elastic contact by the energizing force of the spring 19 is provided, whereby an idling condition can be held by bringing the projection 31 into elastic contact with said idling-controlling surface 35 by operating the operation handle 18 and thus an input range of a tension of the load-chain during the idling-control can be expanded. As a result, the load-chain can be adjusted in length without requiring any special skill. Furthermore, the engaging stepped portion 37 is provided at the rear end portion in the drivenly rotating direction of the projection 32 and the projection 37 is brought into elastic contact with the inclined surface 31*a* of the projection 31 during the time when the mechanical brake 13 is being operated, so that the hoist and traction operation by the reciprocal operation of the operation lever becomes possible by a simple construction utilizing the projection 32 even under the no-load condition.

Moreover, the driving member 8 can be rotated by an action of the idling-controlling spring 50 to loosen the mechanical brake 13 by the simple operation of merely drawing the operation handle 18 to the outside position far from the driving member 8 by providing the idling-controlling spring 50 between the driving member 8 and the operation handle 18. Consequently, even in the case where the idling operation is conducted by an inexperienced person, the idling operation can be easily achieved, the operatability being able to be improved, and operational error can be eliminated.

Besides, the position where the inclined surface 31*a* of the engaging projection 31 provided on the operation handle 18 is brought into elastic contact with the engaging stepped portion 37 provided on the driving member 8 when the inclined surface 31*a* is brought into elastic contact with the engaging stepped portion 37 can be set to a suitable one, that is one near a top portion of the projection 31 in the inclined surface 31*a*, in high accuracy by merely adjusting the position of the operation handle 18 in the circumferential direction relative to the stopper 17, in short by the simple operation of merely changing the engaging positions of the concave and convex portions 29, 30, by providing a plurality of at least one of the concave portions 30 and the convex portions 29 provided between the opposite surfaces of the stopper 17 and the operation handle 18 at regular intervals in the circumferential direction and selecting their pitch angles so as to be different from those of said concave and convex grooves 17*a*, 23*a* connecting the stopper 17 with the driving shaft 5 and ones obtained by multiplying the pitch angles of the concave and convex grooves 17*a*, 23*a* by integers. Additionally, the adjustment of this elastically contacting position can be easily achieved even though a lining plate of the mechanical brake 13 is abraded and the elastically contacting position is out of order.

What is claimed is:

1. A structure for controlling braking actions of a mechanical brake of a lever type hoist and traction machine comprising:

a load sheave;

a driving shaft, having a driven member, for driving said load sheave;

a driving member threadedly mounted on said driving shaft and having teeth on its outer periphery and;

a mechanical brake provided between said driven member and said driving member;

an operation lever, having a feed click switchably engageable with said teeth, for driving said driving member in regular and reverse directions by a reciprocal operation of said operation lever;

a stopper provided at an axial end portion of said driving shaft;

an operation handle interposed between said stopper and said driving member to be axially movable but non-rotatable relative to said driving shaft; and a spring for biasing said operation handle toward said driving member, said driving member being provided, at a portion thereof facing said operation handle, with an engaging stepped portion, and said operation handle being provided, on a surface thereof facing said driving member, with an engaging projection projecting toward said driving member, wherein there is provided an inclined surface having a slope successively extending from and integral with said engaging projection, said surface being inclined forwardly with respect to a regular rotation direction of said driving member from a top end portion of said projection on a fore side with respect to a regular rotation direction of said driving member toward a base end of said projection, and said inclined surface is resiliently contacted with the engaging stepped portion via a biasing force of said spring in an operative mode of said mechanical brake, so as to apply to said driving member a component force acting in a brake tightening direction, and wherein an idle-controlling spring for rotatably biasing said driving member in a brake loosening direction of said mechanical brake is interposed between said driving member and said operation handle.

2. A structure as set forth in claim 1 in which a projected portion engaged with an end face in the axial direction of the engaging projection provided on the operation handle during a rotational operation of the operation handle relative to the driving member and having an idling-controlling surface brought into elastic contact therewith by said biasing force of the spring provided on a surface opposite to the operation handle and said projected portion is provided with said engaging stepped portion at a rear end portion in the rotational direction thereof.

3. A structure as set forth in claim 5, in which the stopper is connected with the driving shaft by a connecting structure using a large number of concave and convex grooves, concave portions and convex portions engaged with said concave portions being provided between opposite surfaces of the stopper and the operation handle, at least one of the concave portions and said convex portions being provided at regular intervals in the circumferential direction, and their pitch angles being selected so as to be different from those of said concave and convex grooves provided between the stopper and the driving shaft and pitch angles obtained by multiplying said pitch angles of the concave and convex grooves by integers.

* * * * *